US012799576B2

(12) United States Patent
Johnson et al.

(10) Patent No.: US 12,799,576 B2
(45) Date of Patent: Nov. 17, 2026

(54) MASKLESS TOUCH UP TOOL FOR SURFACE COATINGS

(71) Applicant: Blue Origin Manufacturing, LLC, Huntsville, WA (US)

(72) Inventors: Kevin Mark Johnson, Merritt Island, FL (US); Susan Carlson, Melbourne, FL (US); Jacob Lowell Ellis, Merritt Island, FL (US); Michael Kenneth Moore, Rockledge, FL (US)

(73) Assignee: Blue Origin Manufacturing, LLC, Huntsville, AL (US)

( * ) Notice: Subject to any disclaimer, the term of this patent is extended or adjusted under 35 U.S.C. 154(b) by 0 days.

(21) Appl. No.: 18/935,097

(22) Filed: Nov. 1, 2024

(65) Prior Publication Data

US 2025/0320596 A1 Oct. 16, 2025

Related U.S. Application Data

(63) Continuation of application No. 18/632,095, filed on Apr. 10, 2024.

(51) Int. Cl.
*C23C 8/04* (2006.01)

(52) U.S. Cl.
CPC ..... *C23C 8/04* (2013.01)

(58) Field of Classification Search
CPC ..... B05C 17/00
See application file for complete search history.

(56) References Cited

U.S. PATENT DOCUMENTS 1,401,436 A * 12/1921 Pannier ..... B41K 1/40 101/201
4,856,136 A * 8/1989 Janssen ..... A46B 3/02 15/210.1
5,702,759 A 12/1997 White et al.
9,770,737 B1 9/2017 Polhert et al.
(Continued)

FOREIGN PATENT DOCUMENTS

CN 201735499 2/2011
DE 19859864 10/2007

OTHER PUBLICATIONS

Mcmaster-Carr, "Gasket Tape," https://www.mcmaster.com/gaskets/gasket-tape-5/, Accessed Apr. 10, 2024.
(Continued)

*Primary Examiner* — Robert A Vetere
(74) *Attorney, Agent, or Firm* — Knobbe, Martens, Olson & Bear, LLP

(57) ABSTRACT

A maskless touch up tool having a faceplate and handle. The faceplate is placed on a surface for touching up of a coating on the surface. The surface may be on a rocket body. The faceplate may form a seal around a target region of the surface. The faceplate has an opening configured to receive a touch up coating therethrough for application of the touch up coating to the surface. The handle may extend away from the faceplate and be configured for gripping by a user. The tool may include a reservoir, or an attachment for an external container, configured to collect excess touch up coating from the surface. The tool may be used to touch up the surface coating without the need for masking of the surface.

18 Claims, 6 Drawing Sheets

(56) References Cited

U.S. PATENT DOCUMENTS

| | | | |
|---|---|---|---|
| 2009/0266377 | A1 | 10/2009 | Matsumoto et al. |
| 2012/0134737 | A1 | 5/2012 | Ling et al. |
| 2017/0136491 | A1* | 5/2017 | Chase ..... B05D 1/322 |
| 2018/0369860 | A1* | 12/2018 | Daly ..... B05C 17/0333 |
| 2022/0002002 | A1 | 1/2022 | Flood et al. |
| 2022/0266292 | A1 | 8/2022 | Humphrys et al. |
| 2025/0320594 | A1 | 10/2025 | Johnson et al. |
| 2025/0320595 | A1 | 10/2025 | Johnson et al. |
| 2025/0320597 | A1 | 10/2025 | Johnson et al. |

OTHER PUBLICATIONS

Mcmaster-Carr, "Steam- and Chemical-Resistant Packing Seals," https://www.mcmaster.com/seals/steam-and-chemical-resistant-packing-seals/, Accessed Apr. 10, 2024.

* cited by examiner

MASKLESS TOUCH UP TOOL FOR SURFACE COATINGS

CROSS REFERENCE TO RELATED APPLICATIONS

Any and all applications for which a foreign or domestic priority claim is identified in the Application Data Sheet as filed with the present application are hereby incorporated by reference under 37 CFR 1.57. For example, the present application is a continuation of U.S. application Ser. No. 18/632,095, filed on Apr. 10, 2024, entitled "MASKLESS TOUCH UP TOOL FOR SURFACE COATINGS," the disclosure of which is hereby incorporated by reference herein in its entirety for all purposes and forms a part of this specification.

FIELD

This development relates generally to surface coatings, in particular to systems and methods for touching up surface coatings without using masking.

BACKGROUND

Surfaces of rocket bodies and other structures may have a coating, such as a chromate conversion coating. Some coatings may be used to improve the corrosion resistance of bare metal and as a primer to improve adherence of paints and adhesive. The coating may also provide resistance to abrasion and light chemical damage on soft metal. Coatings are traditionally applied to a surface by dipping, spraying, or brushing. Such coatings may become damaged or worn and require touching up.

Touching up coatings on some surfaces is difficult, such as on shot-peened panels. A shot peened surface does not allow for traditional mechanical abrasion prior to touch up. Further, in order to perform the repair work, an operator must use chemical preparation methods that require extensive masking. Masking is an adhesive tape that prevents application of the touch up coating to the surface covered by the masking. Masking using adhesives may damage the surface. Masking may damage a previously applied chromate conversion coating due to the soft nature of the coating.

Additionally, when the surface is in a vertical position, such as a surface on a body of a vertical rocket intended to be re-used after a launch and landing, chemical drippage during touch up may drip down the surface and compromise areas that do not need touch up. Traditional methods of preventing drippage include the use of absorbent materials, such as rags or towels, to catch excess coating. These materials become hazardous waste after use and require proper disposal.

Thus, there exists a need for improvements to touching up coatings that do not use masking, which limit or prevent the need for absorbent materials to remove excess coating, and that overcome other drawbacks of existing solutions.

SUMMARY

Systems and methods are described for maskless touch up of a coating, such as a chromate conversion coating, on a metal surface, such as a rocket body. A maskless touch up tool is described having a faceplate and handle. The tool may be used to touch up a surface coating without the need for masking of the surface. The tool can be used to apply a variety of different coatings to a variety of different surfaces.

The embodiments disclosed herein each has several aspects no single one of which is solely responsible for the disclosure's desirable attributes. Without limiting the scope of this disclosure, its more prominent features will now be briefly discussed. After considering this discussion, and particularly after reading the section entitled "Detailed Description" one will understand how the features of the embodiments described herein provide advantages over existing approaches to touching up coatings of surfaces.

In some aspects, the techniques described herein relate to a tool for touching up a coating on a surface, the tool including: a faceplate on a distal end of the tool and configured to be placed on the surface, the faceplate having an opening configured to surround a target region of the surface such that the coating can be applied to the target region through the opening; a handle attached with and located proximally of the faceplate; and a reservoir located adjacent to the faceplate, the reservoir configured to collect excess of the coating from the target region.

In some aspects, the techniques described herein relate to a tool further including a runoff portion configured to direct the excess of the coating towards the reservoir.

In some aspects, the techniques described herein relate to a tool, wherein the faceplate includes a seal configured to form a sealing interface with at least part of the surface.

In some aspects, the techniques described herein relate to a tool, wherein the faceplate is configured to detach from the tool.

In some aspects, the techniques described herein relate to a tool, wherein the faceplate includes a distal side having a shape that conforms to a contour of the surface.

In some aspects, the techniques described herein relate to a tool, wherein the faceplate includes an additively manufactured material.

In some aspects, the techniques described herein relate to a tool, wherein the opening is configured to receive an applicator therethrough for application of the coating to the surface.

In some aspects, the techniques described herein relate to a tool for touching up a coating of a surface, the tool including: a proximal end including a handle; a distal end including a removable faceplate having an opening, the faceplate configured to be placed on the surface such that the opening surrounds a target region of the surface, and the faceplate is configured to removably couple to the distal end; and the faceplate further including a seal coupled to a distal side of the faceplate, the seal configured to form a sealing interface with the surface when the tool is applied to the surface.

In some aspects, the techniques described herein relate to a tool further including a reservoir configured to collect excess of the coating from the target region.

In some aspects, the techniques described herein relate to a tool further including an angled runoff portion configured to direct the excess of the coating away from the target region to the reservoir.

In some aspects, the techniques described herein relate to a tool further including a drain in the reservoir leading to an attachment configured to attach with a container for collecting the excess of the coating through the drain.

In some aspects, the techniques described herein relate to a tool, wherein the handle extends linearly between two support members.

In some aspects, the techniques described herein relate to a tool, wherein the faceplate is square or circular.

In some aspects, the techniques described herein relate to a method of touching up a coating of a surface using a touch up tool, the method including: positioning an opening of a distal end of the touch up tool about a target region of the surface to be touched up; forming a sealing interface at least partially around the target region; applying a coating through the opening and onto the target region of the surface; preventing excess of the coating from migrating from the target region onto another region of the surface; and removing the touch up tool from the surface.

In some aspects, the techniques described herein relate to a method further including collecting the excess of the coating from the target region within the touch up tool.

In some aspects, the techniques described herein relate to a method further including holding a proximal end of the touch up tool.

In some aspects, the techniques described herein relate to a method, wherein applying the coating includes applying a chromate conversion coating to the surface of a metal rocket body.

In some aspects, the techniques described herein relate to a method further including attaching the distal end to the tool.

In some aspects, the techniques described herein relate to a method, wherein the method does not include masking the surface.

In some aspects, the techniques described herein relate to a method, wherein applying the coating includes placing an applicator through a second opening of the tool.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several embodiments in accordance with the disclosure and are not to be considered limiting of its scope, the disclosure will be described with additional specificity and detail through use of the accompanying drawings. In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the figures, may be arranged, substituted, combined, and designed in a wide variety of different configurations, all of which are explicitly contemplated and make part of this disclosure.

DETAILED DESCRIPTION

A maskless touch up tool having a faceplate and handle is described. The faceplate is placed on a surface for touching up a coating on the surface. The surface may be on a rocket body. The faceplate may form a seal around a target region of the surface. The faceplate has an opening configured to receive a coating therethrough for application of the coating to the target region of the surface. The handle may be connected with the faceplate and configured for gripping by a user. The tool may include a reservoir, and/or an attachment for an external container, configured to collect excess coating from the surface. In some examples, the reservoir may be located adjacent to the faceplate. The tool may be used to touch up the surface coating without the need for masking of the surface.

The following detailed description is directed to certain specific embodiments of the development. Reference in this specification to "one embodiment," "an embodiment," or "in some embodiments" means that a particular feature, structure, or characteristic described in connection with the embodiment is included in at least one embodiment of the present disclosure. The appearances of the phrases "one embodiment," "an embodiment," or "in some embodiments" in various places in the specification are not necessarily all referring to the same embodiment, nor are separate or alternative embodiments necessarily mutually exclusive of other embodiments. Moreover, various features are described which may be exhibited by some embodiments and not by others.

Various embodiments will now be described with reference to the accompanying figures, wherein like numerals refer to like elements throughout. The terminology used in the description presented herein is not intended to be interpreted in any limited or restrictive manner, simply because it is being utilized in conjunction with a detailed description of certain specific embodiments of the development. Furthermore, embodiments of the development may include several novel features, no single one of which is solely responsible for its desirable attributes, or which is essential to practicing the present disclosure.

Figure 1:
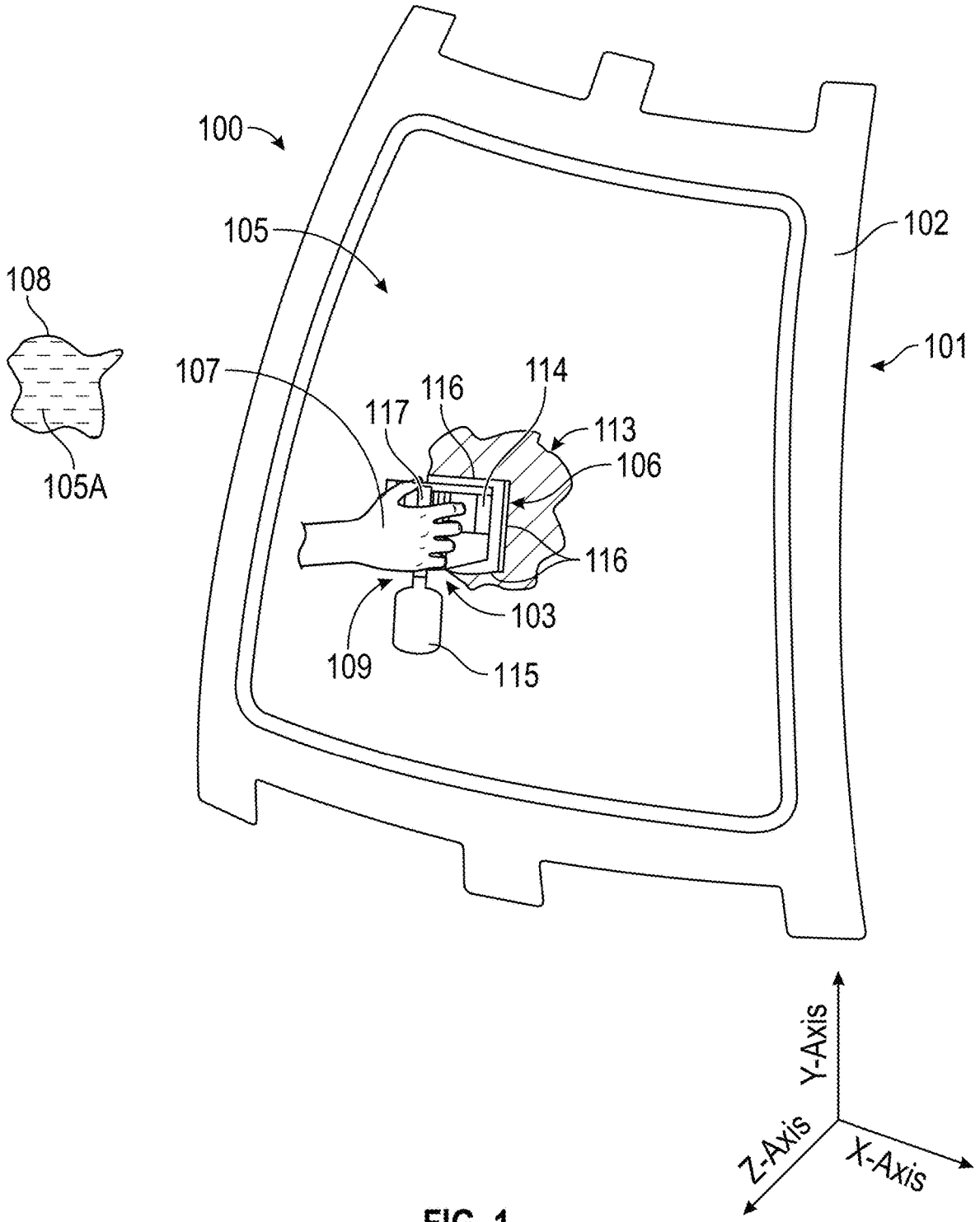
FIG. 1 is a perspective view of an example touch up tool applied by a human hand to an example surface, shown as a surface of a metal panel of a rocket body.

FIG. 1 illustrates an example system 100 for applying touch up coating 105A to a surface 102. The system 100 includes a panel 101 and a touch up tool 103. The panel 101 includes the surface 102 with a coating 105, such as a chromate conversion coating, covering a portion of the surface 102. The coating 105 may be an original coating applied to the surface 102. An applicator 108, such as a rag as illustrated in FIG. 1, includes the touch up coating 105A for application to the surface 102 for touching up of the coating 105.

For reference, an XYZ axis system is shown in various figures. The Z-axis defines a longitudinal axis of the tool 103 and extends in proximal and distal directions. As used herein, "distal," and the like indicates a direction towards or closer to the surface 102, and "proximal" indicates a direction opposite the distal direction that is away from or farther from the surface 102. When the tool is used, the Z-axis may be parallel to a normal vector of the surface of the target region. The Y-axis is perpendicular to the Z-axis and extends generally in a vertical, upward direction opposite that of gravity. References herein to "upper," "lower," "vertical," and the like are in reference to directions generally parallel to the Y-axis. The X-axis is perpendicular to both the Y- and Z-axes according to the "right hand rule" and extends generally in a horizontal direction. References herein to "lateral," "horizontal," "transverse" and the like are in reference to directions generally parallel to the X-axis. The tool 103 may have a distal end 106 facing the surface 102 and an opposite, proximal end 109 facing away from the surface 102. The distal end 106 may include features that facilitate application of the touch up coating 105A to a desired region of the surface 102. The proximal end 109 may include features that facilitate positioning and holding the tool 103 about that region, as further described. The tool 103 may include a container 115 for collecting excess of the touch up coating 105A.

The coating 105 may include an area for repair 113. The area for repair 113 may be worn or damaged, for example where the coating 105 is worn off, and require touch up by application of additional coating 105A. The tool 103 may extend from the distal end 106 near or on the surface 102 to the proximal end 109 located near a user's hand 107. The user's hand 107 may grip the proximal end 109 of the tool 103. The distal end 106 of the tool 103 may contact the surface 102 to surround a target region 114 of the area for repair 113. The target region 114 may include a portion or all of the area for repair 113. The target region 114 of the surface 102 may be surrounded by the tool 103 with the tool 103 extending proximally therefrom. With the tool 103 contacting the surface 102, the touch up coating 105A may be applied to the target region 114 of the surface 102 using the applicator 108. The applicator 108 may be a wipe, a brush, a rag, a spray canister, or other type of coating applicator. The applicator 108 may apply the touch up coating 105A to the target region 114 by placing the applicator 108 through one or more openings of the tool 103 and onto the surface 102, as further described.

The surface 102 may be curved as shown, or flat, or have other contours. The surface 102 may be generally in a plane defined by the X- and Y-axes. The surface 102 may be any surface of any component containing a coating in need of touching up. "Touching up" as used herein has its usual and customary meaning, and includes without limitation applying the touch up coating 105A to an area of the surface 102 where the coating 105 is missing, damaged, scratched, thinned, etc. The touch up coating 105A may be the originally applied coating. In some embodiments, the surface 102 may be a shot-peened metal panel configured for use in an aerospace application, such as a fairing or other portion of a rocket body. The tool 103 may be used to touch up the surface 102 located on an external side of the panel. Other types of components or panels having other embodiments of the surface 102 may also be touched up using the tool 103.

The surface 102 may be oriented vertically with respect to gravity, e.g., generally parallel to the Y-axis. Any excess of the touch up coating 105A applied to the target region 114 may migrate, e.g., flow or drip, due to gravity and/or thickness of the applied touch up coating 105A. The tool 103 may prevent or limit such excess coating from migrating from the target region 114 to another region of the surface 102 outside the target region 114. The tool 103 may form a sealing interface 116 about the target region 114. The sealing interface 116 may completely enclose, or partially extend about, the target region 114. The sealing interface 116 may be formed by a distal end of the tool 103 that contacts the surface 102. The sealing interface 116 may form an impermeable boundary that prevents migration of the applied touch up coating 105A beyond the sealing interface 116.

The tool 103 may be configured to allow the user's hand 107, e.g., with a glove, to hold, locate and apply the tool 103 to contact the surface 102. The hand 107 may locate the tool 103 about the target region 114 on the surface 102 in order to apply the touch up coating 105A. The tool 103 may be configured to stay on the surface 102 while the touch up coating 105A is being applied to the target region 114. The tool 103 may be configured to contact and to be removed from contact with the surface 102 without damaging the surface 102. The portion of the surface 102 contacted by the tool 103, for example at the sealing interface 116, may therefore have the same qualities prior to and after removal of the tool 103. Such qualities may include coating thickness, color, finish, flatness, smoothness, etc.

The tool 103 is configured to be used without the need for applying masking (not shown). Masking is adhesive material applied temporarily around the target region 114 to prevent application of coating to, and/or protect, areas of the surface 102 outside the target region 114 or masked area. Masking generally will provide a physical barrier between the target region 114 and other areas of the surface 102. Masking can be a solid mask, such as tape, or a liquid mask. Application and/or removal of masking can damage the surface 102 and/or require additional time-consuming steps. Advantageously, use of the tool 103 may reduce or eliminate the risk of damage to the surface 102 that is typically associated with masking while still allowing for application of the touch up coating 105A to confined areas.

The tool 103 may have various other features and functions as described herein with respect to other tool embodiments, and vice versa. Various non-limiting embodiments of tools that may be used in the system 100 as described with respect to FIG. 1 are illustrated in, and described with respect to, FIGS. 2A-5B.

Figure 2B:
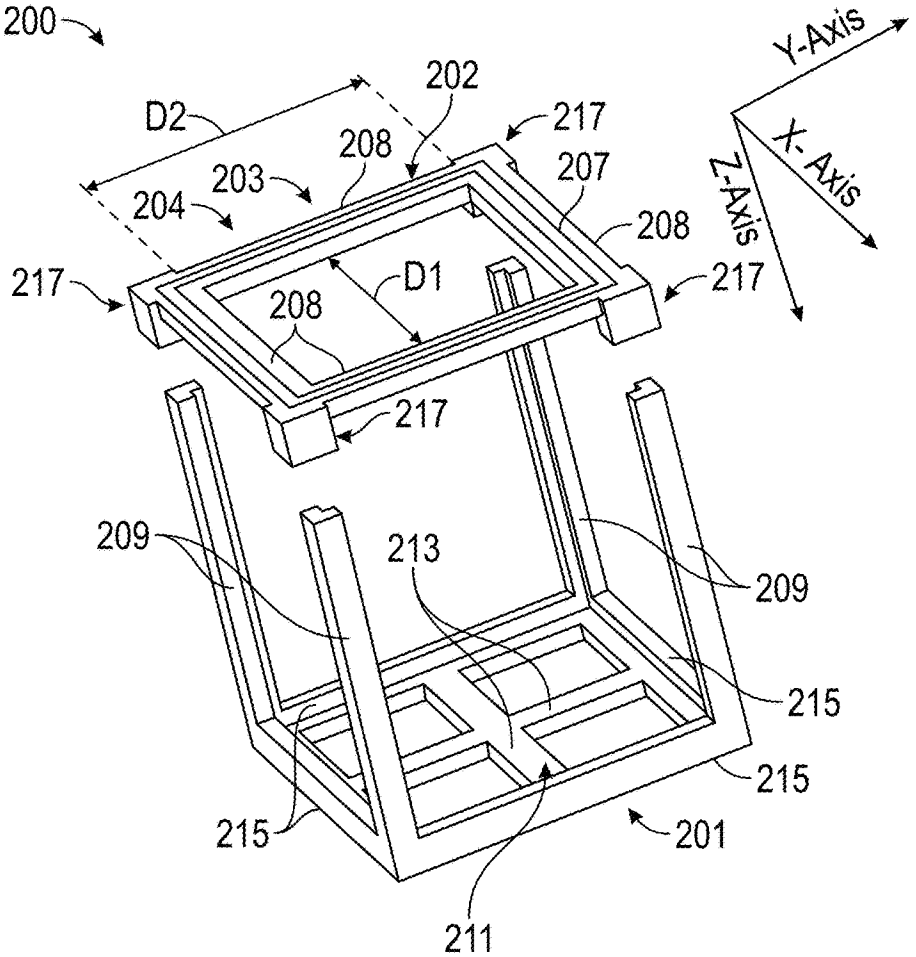
FIGS. 2A and 2B are perspective views of an assembled and disassembled embodiment of a touch up tool, respectively, having a detachable square faceplate and cross-shaped handle, and that may be used with the surface of FIG. 1.
Figure 2A:
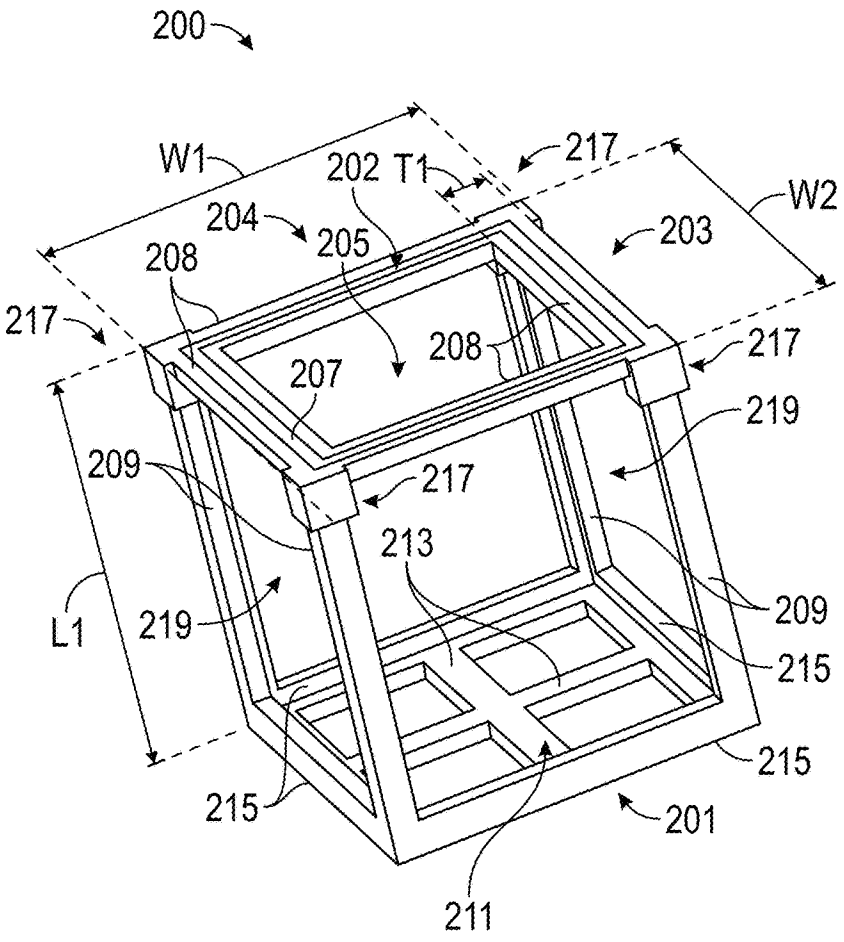
Figure 3B:
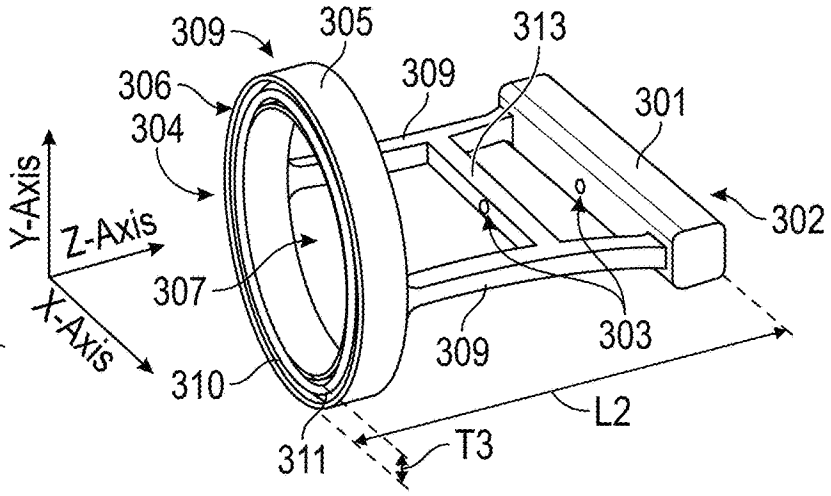
FIGS. 3A-3D illustrate various views of another embodiment of a touch up tool, having a rounded faceplate and a linear handle, and that may be used with the surface of FIG. 1.
Figure 3A:
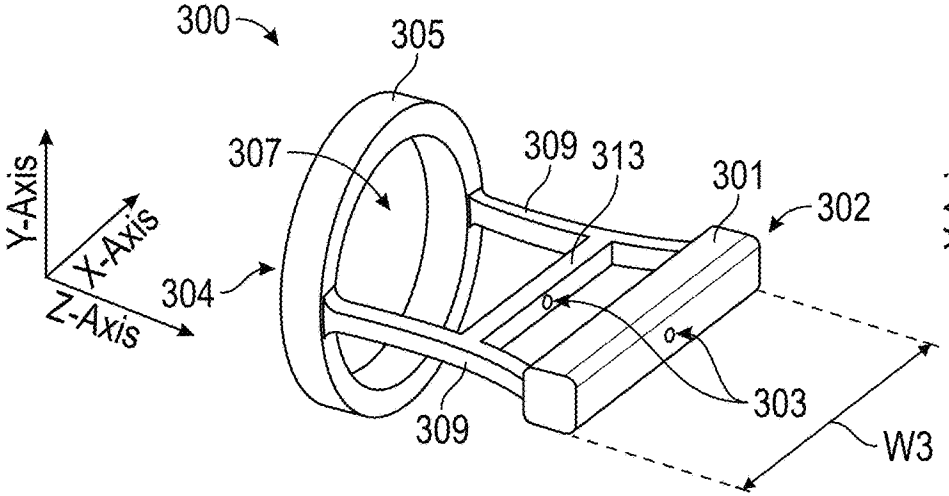
Figure 3D:
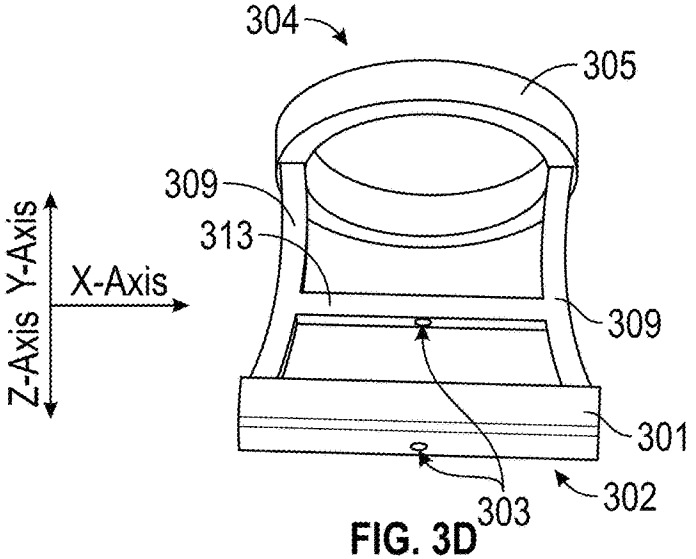
Figure 3C:
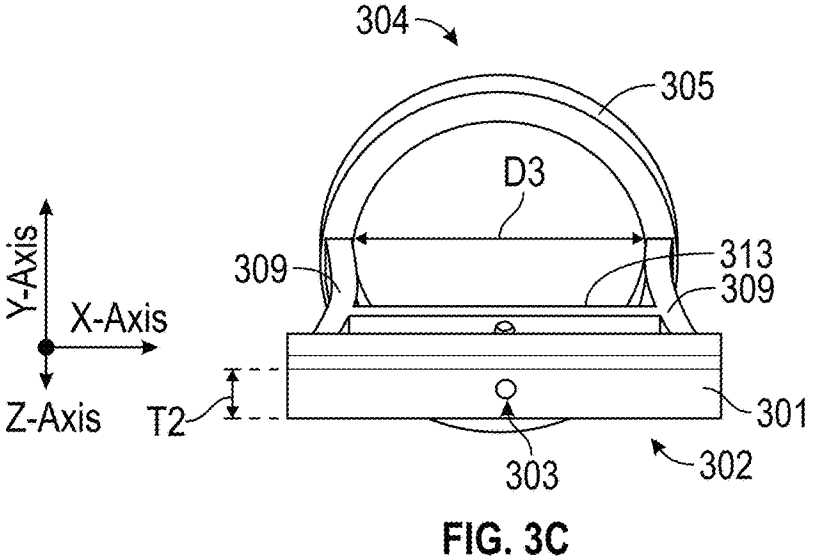
Figure 4B:
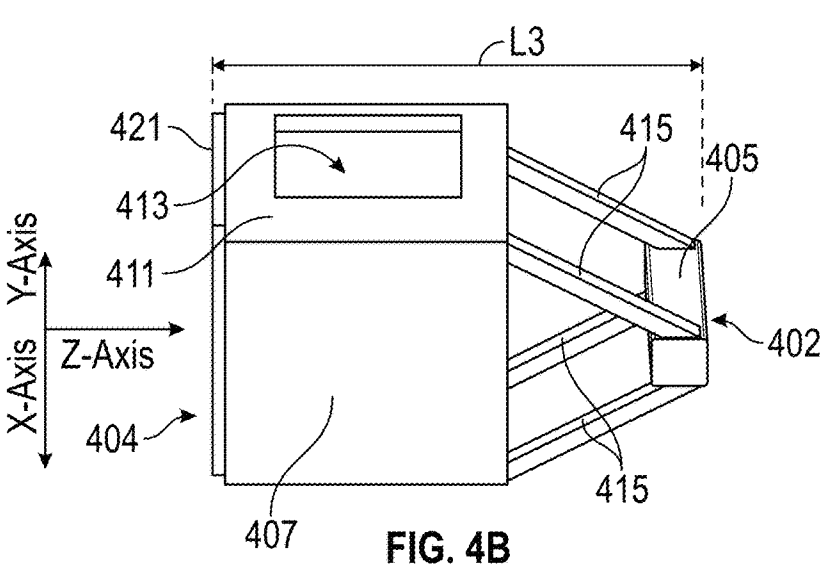
FIGS. 4A-4D illustrate various views of another embodiment of a touch up tool having a square faceplate and a reservoir for collecting excess coating, and that may be used with the surface of FIG. 1.
Figure 4D:
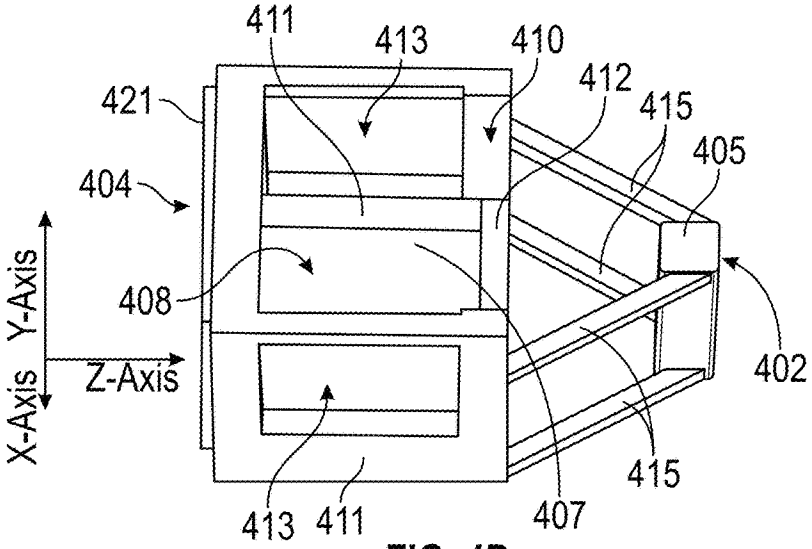
Figure 4A:
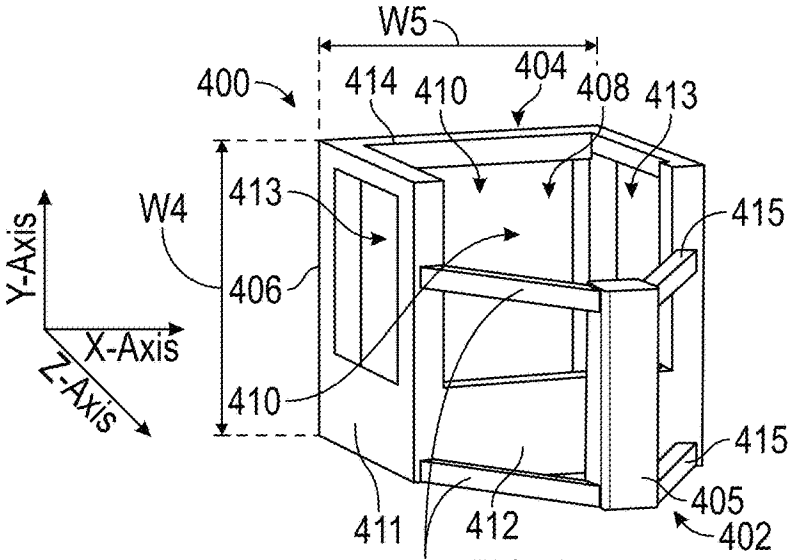
Figure 4C:
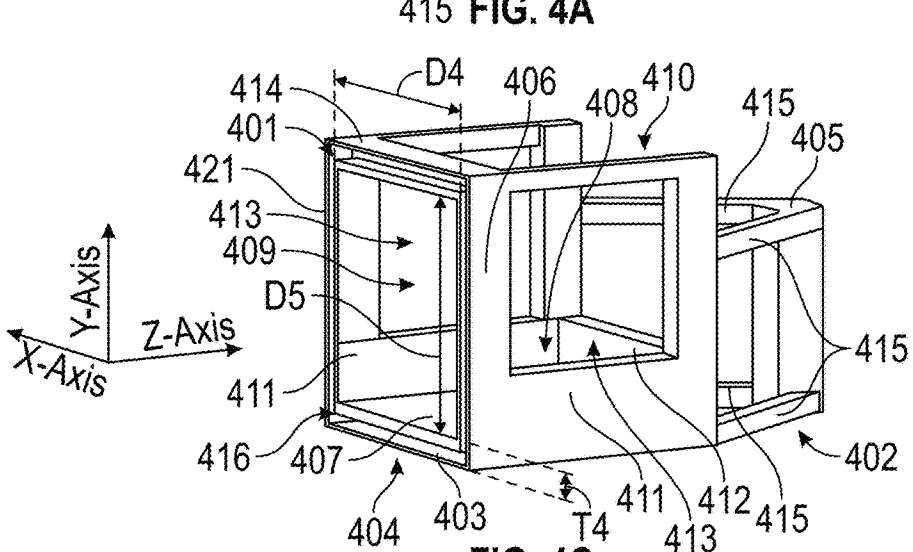

FIGS. 2A and 2B illustrate views of another embodiment of a touch up tool 200. The tool 200 may have any of the features or functions as any other tool described herein, and vice versa. The tool 200 may be used with the system 100 as described with respect to FIG. 1. As shown in FIGS. 2A and 2B, the tool 200 may include a proximal end 201 having a handle 211 and connected with a distal end 204 having a faceplate 203.

The faceplate 203 may include one or more segments 208. As shown, there are four segments 208 extending perpendicular to each other and forming a four-sided faceplate 203, which may be a square or rectangle. The segments 208 extend linearly, with two of the segments 208 extending in the vertical direction and two of the segments 208 extending transversely. The faceplate 203 may have other configurations, such as rounded, circular, etc.

The faceplate 203 may form the sealing interface 116 with the surface 102 (see FIG. 1). The faceplate 203 may have a distal side 202. The distal side 202 may extend continuously along the distal side of the faceplate. The distal side 202 may surround the target region 114 of the surface 102. Different faceplates 203 having different sizes, shapes, and/or contours may be configured to couple to the proximal end 201 for given sizes, shapes, and/or contours of various target regions 114. For example, a first faceplate 203 may have a planar distal side 202 and be configured to contact a first target region 114 having a corresponding planar contour. A second faceplate 203 may have a curved distal side 202 and be configured to contact a second target region 114 having a corresponding curved contour. The first faceplate 203 may be detached and replaced by the second faceplate 203.

The faceplate 203 may be manufactured, e.g., additively manufactured, also known as "3D printed," based on a contour or shape of the surface 102 to be repaired. The faceplate 203 may be removable from the tool 200. Different faceplates 203 may manufactured and attached to the tool 200 for different contours and surfaces 102.

The faceplate 203 may attach to and detach from the proximal end 201. A proximal side of the faceplate 203 may couple with distal ends of one or more members 209 of the proximal end 201. The faceplate 203 may couple to the members 209 via snap fit, friction fit, mechanical fixation such as a screw, tape, or adhesive. The faceplate 203 may be configured to couple to the proximal end 201 of the tool 200 via one or more sockets 217 or other coupling mechanisms configured to receive the members 209. The members 209 may extend longitudinally and distally from the proximal end 201 towards the faceplate 203. As shown, the faceplate 203 has four corners that each include one of the sockets 217 that attach with a distal end of the respective member 209. Each socket 217 of the faceplate 203 may form a cavity therein that receives the distal end of the respective member 209. Each socket 217 may be configured to friction fit or snap fit with the respective member 209 so as to provide a removable coupling of the faceplate 203 and proximal end 201. There may be a plurality of sockets 217, with each socket 217 associated with each member 209.

The faceplate 203 may be deformable. In some embodiments, the faceplate 203 may be manufactured, e.g., additively manufactured, to match different contours of different regions of the surface 102. In some embodiments, the faceplate 203 may be flexible such that the faceplate 203 conforms to a non-planar topography of the surface 102 to form the sealing interface 116. In other embodiments, the faceplate 203 may be rigid, or partially rigid and partially flexible. The faceplate 203 may include flexible components thereon.

In some embodiments, the faceplate 203 may have a seal 207, such as a gasket as shown. The seal 207 may be on a distal side of the faceplate 203. The seal 207 may be on or in the distal side 202 of the faceplate 203. The seal 207 may extend along and follow the entire distal side 202 of the tool 200 to form a closed shape, such as a square, etc. The seal 207 may be coupled with the distal side 202 of the faceplate 203. The seal 207 may be adhered or otherwise mechanically secured with the distal side 202. The seal 207 may be attached to a flat surface of the faceplate 203 or received into a groove or channel of the distal side 202, for example as described herein with respect to other embodiments (see, e.g., FIGS. 3A-3D). The faceplate 203 may be manufactured with or without the groove. The seal 207 and faceplate 203 may be a single monolithic piece of material, or the seal 207 may be a separate part attached with the faceplate 203. The seal 207 may form the sealing interface 116 with the surface 102. The faceplate 203 may be flexible as described and include the seal 207. In some embodiments, the seal 207 may extend on a radially inward or outward side of the faceplate 203. The seal 207 may include a material configured to deform when applied to the surface 102.

The tool 200 can include a first width W1 and a second width W2 corresponding to outer dimensions of the tool 200, for example outer dimensions of the faceplate 203, in the XY plane. The widths W1, W2 may include the outer width of the faceplate 203 and/or handle 211. The widths W1, W2 may be no more than two inches, no more than three inches, no more than four inches, no more than five inches, no more than six inches, no more than 12 inches, from two to 12 inches, or from two to six inches. The width W1 may be less than, the same as, or greater than, the width W2. The faceplate 203 may have a thickness T1, which may be a thickness of one of the segments 208 in the lateral and/or vertical directions. The thickness T1 may be a thickness of the distal side 202. The thickness T1 may be a thickness of the seal 207. The thickness T1 may be no more than a quarter of an inch, no more than a half an inch, no more than three quarters of an inch, no more than one inch, no more than one and a half inches, no more than two inches, from a quarter of an inch to two inches, or from half an inch to an inch and a half. The thickness T1 may change, e.g., increase, in response to contact of a deformable faceplate 203 and/or seal 207 against the surface 102.

The distal end 204 of the tool 200 may define an opening 205. The faceplate 203 may define the opening 205. As shown, there may be a single opening 205 formed by the segments 208 of the faceplate 203. However, more than one opening 205, such as two, three, four or more openings 205, may be defined by the faceplate 203. The opening 205 may be large enough to allow the user to pass the applicator 108 through the opening 205 and onto the surface 102. The opening 205 may span a first distance D1 in a lateral direction and a second distance D2 in a vertical direction. The distances D1 and D2 may be no more than two inches, no more than three inches, no more than four inches, no more than five inches, no more than six inches, no more than 12 inches, in the range of two to 12 inches, or in the range of two to six inches.

The opening 205 may surround the target region 114 when the tool 200 is applied to the surface 102. The user may apply the touch up coating 105A by placing the applicator 108 through the opening 205 of the faceplate 203 so as to reach the target region 114 of the surface 102 to be repaired. When the touch up coating 105A is applied through the opening 205, any excess of the touch up coating 105A is contained within the area enclosed by the opening 205 on the surface 102, preventing drippage of the excess of the touch up coating 105A on regions of the surface 102 outside the target region 114. The seal 207 and resulting sealing interface 116 may provide a boundary that contains the excess of the touch up coating 105A within the target region 114 and/or directs the excess of the touch up coating 105A into the tool 200 for collection.

The tool 200 may include a handle 211. The proximal end 201 may include the handle 211. The handle 211 may be a structure by which the user may grasp or hold the tool 200, either directly with the user's hand 107 or with a secondary tool or equipment, such as a stand or robotic arm. The handle 211 can include one or more bars 213 or other components by which the user can grasp the proximal end 201. The one or more bars 213 may extend linearly from opposing proximal members 215 of the proximal end 201. There may be four proximal members 215 forming a closed perimeter, such as a square as shown, at the proximal end 201 of the tool 200. The bars 213 may extend radially inward from a respective one of the members 215 towards a center of the tool 200. The bars 213 may connect together or form a monolithic piece. The bars 213 may be located within a plane at the proximal end of the tool 200. The bars 213 may form a cross or other structure to facilitate the user grasping the proximal end 201 of the tool 200. The tool 200 may have an overall length L1, which may extend from a proximal side of the handle 211 to the distal side 202. The length L1 may be no more than two inches, no more than four inches, no more than six inches, no more than eight inches, no more than ten inches, no more than 12 inches, no more than 16 inches, no more than 20 inches no more than 24 inches, no more than 36 inches, from two to 36 inches, or from four to 24 inches.

The tool 200 or any portions thereof may be composed of one or more materials, including but not limited to metal, plastic, polymer, other machinable or printable material, or combinations thereof. The handle 211 may be composed of the same or different materials than the faceplate 203. The handle 211 may be composed of a machined material, such as metal, and the faceplate 203 may be composed of a printable material, such as a polymer, or vice versa.

FIGS. 3A-3D illustrate perspective views of another example embodiment of a touch up tool 300. The tool 300 may have any of the features or functions as any other tool described herein, and vice versa. The tool 300 may be used with the system 100 as described with respect to FIG. 1.

The tool 300 may include a faceplate 305. The faceplate 305 may have any of the features of other faceplates described herein, and vice versa. The faceplate 305 may be at a distal end 304 of the tool 300. The faceplate 305 is configured to contact the surface 102 and surround the target region 114. The faceplate 305 may be ring shaped. The faceplate 305 may have other shapes, such as oval, elliptical, rounded, square, triangular, rectangular, other polygonal shapes, or combinations thereof. The faceplate 305 extends continuously to form an enclosed perimeter.

The tool 300 includes an opening 307 at the distal end 304 of the tool 300. The opening 307 may be defined by and extend through the faceplate 305. The opening 307 may have the same shape as the faceplate 305, e.g., circular, etc. In some embodiments, the faceplate 305 and opening 307 may have different shapes, such as a square or rectangular faceplate 305 and a circular or rounded opening 307, etc. The opening 307 may form an enclosed shape. In some embodiments, the shape of the opening 307 may not be enclosed, e.g., with a U-shaped or horseshoe-shaped faceplate 305, or other open shapes.

The opening 307 may be sized to allow the applicator 108 to apply the touch up coating 105A to the surface 102. The opening 307 may define a lateral width D3, which may be a diameter for a circular opening 307. The lateral width D3 may extend between opposing radially inward surfaces of the faceplate 305. The lateral width D3 may be no more than one inch, no more than two inches, no more than three inches, no more than four inches, no more than five inches, no more than six inches, no more than seven inches, no more than eight inches, no more than nine inches, no more than ten inches, no more than 12 inches, no more than 16 inches, no more than 20 inches, no more than 24 inches, from two to 24 inches, or from four to 20 inches.

The faceplate 305 has a distal side 306 that contacts the surface 102 when the tool 300 is applied to the surface 102. The distal side 306 of the faceplate 305 may have the same or similar features as the distal side 202 of the tool 200, and vice versa. Thus, the distal side may have a contour that matches a corresponding contour of the surface 102 or target region 114, etc.

The faceplate 305 may be removeable and have any of the features as described herein with respect to other removeable faceplates, and vice versa. Thus, the faceplate 305 may be integral with the tool 300, such as integral with support members 309, or the faceplate 305 may be removeable from the handle 301, etc. Accordingly, different faceplates 305 may be printed or otherwise manufactured for different applications and the different faceplates 305 may each be configured to removably attach with the tool 300.

The tool 300 may include a seal 311. The seal 311 may have the same features as other seals described herein, and vice versa. The seal 311 may be coupled with the faceplate 305. The faceplate 305 may include a groove 310 configured to receive the seal 311. The seal 311 may be located completely or partially within the groove 310. The groove 310 may be a recess extending proximally into the faceplate 305 and extending along the distal side 306 of the faceplate 305. The seal 311 may be ring-shaped, or other shapes to correspond to the shape of the faceplate 305. The seal 311 may be an O-ring. The seal 311 may be insertable into the groove 310. The seal 311 may be secured within the groove 310 via friction fit and/or adhesive, or other mechanical attachment. The seal 311 may be configured to deform so as to form the sealing interface 116 when applied to the surface 102. The seal 311 may protrude distally beyond the distal side 306 of the faceplate 305. The seal 311 and/or the distal side 306 of the faceplate 305 may contact the surface 102 when the tool 300 is applied to the surface 102. The seal 311 may protrude distally beyond the distal side 306 of the faceplate 305 no more than one sixteenth of an inch, no more than one quarter of an inch, no more than one half of an inch, or no more than an inch. The seal 311 and/or faceplate 305 may compress in the proximal direction during use.

One or more support members 309 extend longitudinally from the faceplate 305. As shown, there are two support members 309 extending distally from the faceplate 305. The support members 309 may be curved. The support members 309 may connect to a proximal side of the faceplate 305. The support members 309 may be connected by a cross member 313 extending laterally across a width of the tool 300. The cross member 313 may couple first and second opposing support members 309, for example to form a cross brace and add stiffness to the tool 300.

The tool 300 may include a handle 301. The handle 301 may include any features of other handles described herein, and vice versa. The handle 301 may be at the proximal end 302 of the tool 300. The handle 301 extends laterally. The handle 301 may extend vertically, or at angles to the lateral or vertical directions. The handle 301 may be parallel or generally parallel with the XY plane, or at an angle to the XY plane. The handle 301 may be composed at least partially of a soft or conforming material. The handle 301 may have a flat proximal side, or the proximal side may be curved or have other contours.

The handle 301 may be sized and shaped to receive and be gripped by the hand 107 of the user. The handle 301 may have a lateral width W3. The width W3 may be no more than four inches, no more than five inches, no more than six inches, no more than eight inches, or from about four inches to about eight inches. The width W3 of the handle 301 may be less than, the same as, or greater than the lateral width D3 of the faceplate 305. The width D3 may be one and a half times or more, two times or more, two and a half times or more, three times or more, four times or more, or five times or more, than the width W3. The handle 301 may have a thickness T2 transverse to the direction of the width W3. The thickness T2 may be no more than a half inch, no more than three quarters inch, no more than one inch, no more than one and a half inches, or no more than two inches.

The tool 300 may have a longitudinal length L2. The length L2 may be measured from the distal side 306 of the faceplate 305 to a proximal side of the handle 301. The length L2 may have any of the lengths as described herein with respect to the length L1 of the tool 200 in FIGS. 2A and 2B.

The tool 300 may be configured to allow the applicator 108 to apply the touch up coating 105A for touch up to the surface 102. The applicator 108 may be placed through the opening 307 to contact the target region 114. The applicator 108 may be placed between opposing support members 309 and through the opening 307.

The proximal end 302 of the tool 300 may include one or more openings 303, e.g., two openings 303 as shown. The handle 301 may include one of the openings 303 and the cross member 313 may include one of the openings 303. The openings 303 may be circular, or other shapes such as oval, elliptical, rounded, square, rectangular, other polygonal shapes, or combinations thereof. The openings 303 may extend through the handle 301 and the support member 313. The openings 303 may be longitudinally aligned. The openings 303 may be configured to couple with a holder, such as a robotic arm or the like for positioning and holding the tool 300 stationary on the surface 102, or with a secondary manual tool used for agitation or chemical clean up.

The distal end 304 of the tool 300 may have a thickness T3 in the vertical and transverse directions. The distal side 306 of the faceplate 305 may have the thickness T3. The thickness T3 may have any of the values as described herein with respect the thickness T2 of the tool 200 of FIGS. 2A and 2B.

FIGS. 4A-4D illustrate various perspective views of another embodiment of a touch up tool 400. The tool 400 may have any of the features or functions as any other tool described herein, and vice versa. As shown, the tool 400 may include a handle 405 on a proximal end 402 of the tool 400, a faceplate 403 on a distal end 404 of the tool 400, and a reservoir 408. The handle 405 and faceplate 403 respectively may have any of the features of other handles and faceplates described herein, and vice versa. The reservoir 408 may be located between the faceplate 403 and handle 405 and facilitate collection of excess of the touch up coating 105A that runs off or otherwise migrates from the target region 114 into the tool 400, as further described.

The faceplate 403 may have any of the features or functions as any other faceplate described herein, and vice versa. The faceplate 403 is defined by an upper segment 414, by distal ends of two lateral sidewalls 411, and by a distal end of a runoff portion 407. Two opposing lateral sidewalls 411 comprise planar structures that extend along lateral sides of the tool 400 in the distal direction. The runoff portion 407 is a planar structure that extends distally along a bottom side of the tool 400. The upper segment 414 extends linearly in the transverse direction between upper portions of distal ends of the two opposing lateral sidewalls 411. Distal sides of the upper segment 414, sidewalls 411 and runoff portion 407 form a continuous distal side 416 of the faceplate 403.

In some embodiments, the faceplate 403 is integral with the tool 400, as shown and described. In some embodiments, the faceplate 403 may be contoured and/or removably coupled to the tool 400. The faceplate 403 may be detachable, such that the faceplate 403 detaches from and attaches to the distal end of the tool 400. For example, the faceplate 403 may be attachable with the distal-facing surfaces of the lateral sidewalls 411 and/or runoff portion 407. The faceplate 403 may have a thickness T4 extending in a radial direction, e.g., the vertical or lateral directions. The thickness T4 may have any of the values as described herein with respect to the thickness T1 of the tool 200 of FIGS. 2A and 2B.

The tool 400 may include a seal 421. The seal 421 may have any of the features or functions as any other seal described herein, and vice versa. The faceplate 403 may be configured to receive the seal 421. The seal 421 may be received in a groove 401 of the faceplate 403. The faceplate 403 and/or seal 421 may be flexible to allow the faceplate 403 to conform to the topography of the surface 102, and thus form the sealing interface 116 between the seal 421 and the surface 102. In other embodiments, the faceplate 403 may be rigid, or partially rigid and partially flexible. The seal 421 may be configured to deform, for example the seal 421 may compress in the proximal direction in response to pressure from the surface 102 upon application of the tool 400 to the surface 102. The seal 421 may be incorporated into the faceplate 403 so that the faceplate 403 is a single material. The seal 421 may be a separate component.

The faceplate 403 defines an opening 409. The opening 409 is formed by inward-facing surfaces of the upper segment 406 of the distal ends of the two lateral sidewalls 411, and of the distal end of the runoff portion 407. A lower part of the opening 409 may lead to the runoff portion 407 of the reservoir 408 at the bottom of the tool 400. Excess of the touch up coating 105A from the target region 114 may flow through the lower part of the opening 409 and into the runoff portion 407. Excess of the touch up coating 105A may flow down along lateral sides of the faceplate 403 toward the lower part of the opening 409 and into the runoff portion 407.

The runoff portion 407 may be associated with a bottom location of the tool 400. The runoff portion 407 may be a planar floor of the reservoir 408. The runoff portion 407 may be configured to capture and/or direct excess of the applied touch up coating 105A from the surface 102. The runoff portion 407 may be configured to direct excess of touch up the coating 105A from flowing outside the target region 114 and to collect the excess of the touch up coating 105A in the reservoir 408.

The runoff portion 407 may partially form the reservoir 408. The reservoir 408 may be formed on a lower side by the runoff portion 407, on lateral sides by the lateral sidewalls 411, and on a proximal side by a proximal end wall 412. The excess of the touch up coating 105A may be collected and trapped within the reservoir 408. The lateral sidewalls 411 and proximal end wall 412 may form boundaries that limit lateral and/or proximal flow of the excess of the touch up coating 105A within the reservoir 408. In some embodiments, the reservoir 408 may include a drain and/or attachment for draining the excess of the coating from the reservoir 408 into an external container, for example as described with respect to FIGS. 5A and 5B.

The tool 400 may include an upper opening 410. The upper opening 410 may be located on an upper side of the tool 400. The upper opening 410 may be defined by upper ends of the lateral sidewalls 411, a proximal side of the upper segment 414, and an upper end of the proximal end wall 412. Additionally, the lateral sidewalls 411 may each include a lateral opening 413. The lateral openings 413 may be located on an upper region of the respective lateral sidewalls 411. The upper opening 410 and the lateral openings 413 may be sized and shaped to receive the applicator 108 therethrough for application of the coating 105A through the opening 409 and onto the surface 102. For example, a human hand may place the applicator 108 through the upper opening 410 or one of the lateral openings 413, through the opening 409, and onto the surface 102.

The handle 405 may have any of the features or functions as any other handle described herein, and vice versa. The handle 405 may extend vertically as shown, or transversely, or in other orientations. The handle 405 may be located at the proximal end 402 of the tool 400 and be configured to receive a user's hand. A distal side of the handle 405 may be supported by one or more support members 415 coupled to proximal ends of the lateral sidewalls 411. The support members 415 may be angled and extend proximally. As shown, there may be four support members 415 inclined proximally and connected with the handle 405.

The handle 405 may be permanently attached or removably attached with the faceplate 403 and/or the reservoir 408. One or more of the handles 405, faceplate 403, and/or reservoir 408 may be formed of a single piece of material, or portions thereof may be separate parts attached together. One or more of the handles 405, faceplate 403, and/or runoff portion 407 may be detachable from other components of the tool 400.

The tool 400 may include the opening 409 at the distal end 404. The opening 409 may have any of the features or functions as any other openings at the distal ends of the tools as described herein, and vice versa. The opening 409 may allow the applicator 108 to pass at least partially through. The opening 409 may be defined by the faceplate 403.

The tool 400 may have a first width W4 extending vertically and a second width W5 extending laterally that correspond to outer dimensions of the tool 400. The widths W4, W5 may be outer widths of the faceplate 403. The widths W4 and W5 may have any of the values as described herein for the widths W1 and W2 for the tool 200 of FIGS. 2A and 2B. The opening 409 may span a first distance D4 in a lateral direction and a second distance D5 in a vertical direction. The distances D4 and D5 may have any of the values as described herein for the widths D1 and D2 for the tool 200 of FIGS. 2A and 2B. The tool may have an overall length L3. The length L3 may extend from the distal side 416 of the faceplate 403 to a proximal side of the handle 405. The length L3 may have any of the values as described herein with respect to the length L1 of the tool 200 of FIGS. 2A and 2B.

Figure 5A:
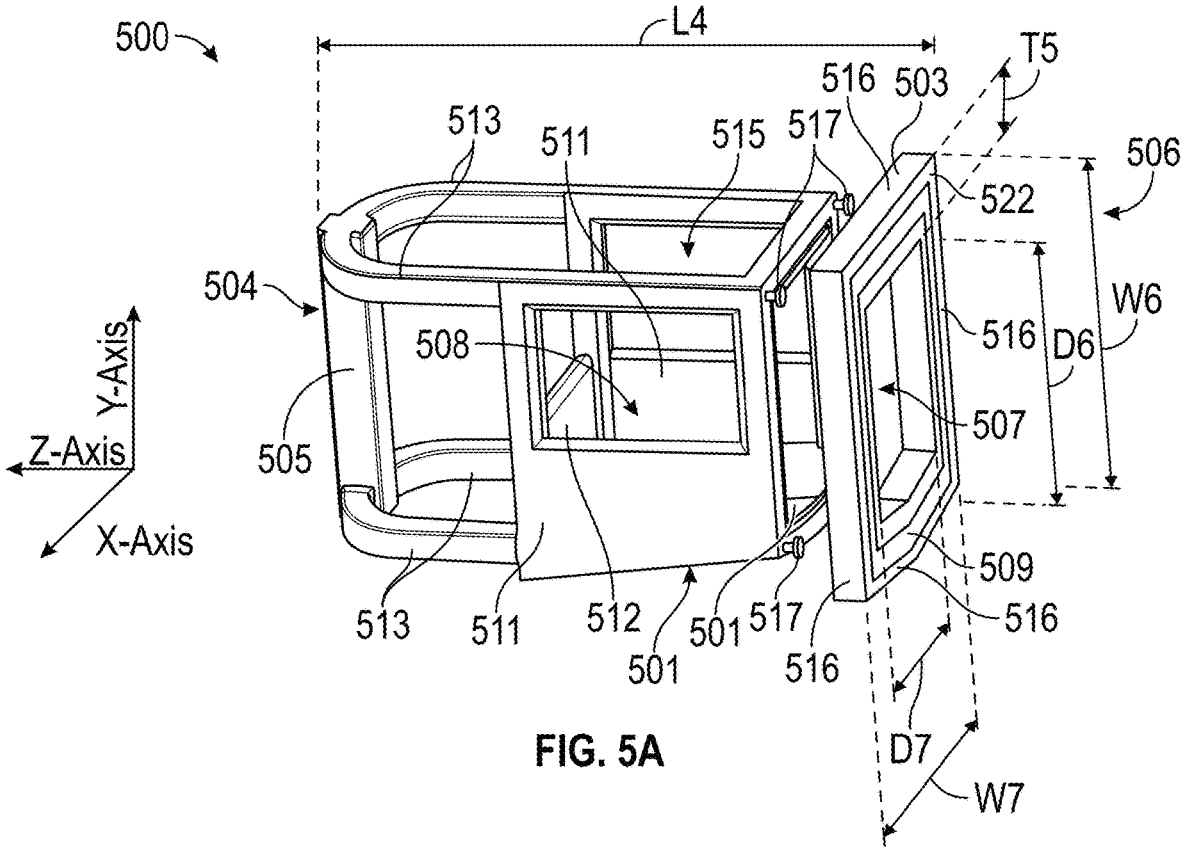
FIGS. 5A and 5B are perspective views of another embodiment of a touch up tool having a removable square faceplate and a reservoir having a drain and attachment for an external container (shown attached in FIG. 5B) to receive excess coating, and that may be used with the surface of FIG. 1.
Figure 5B:
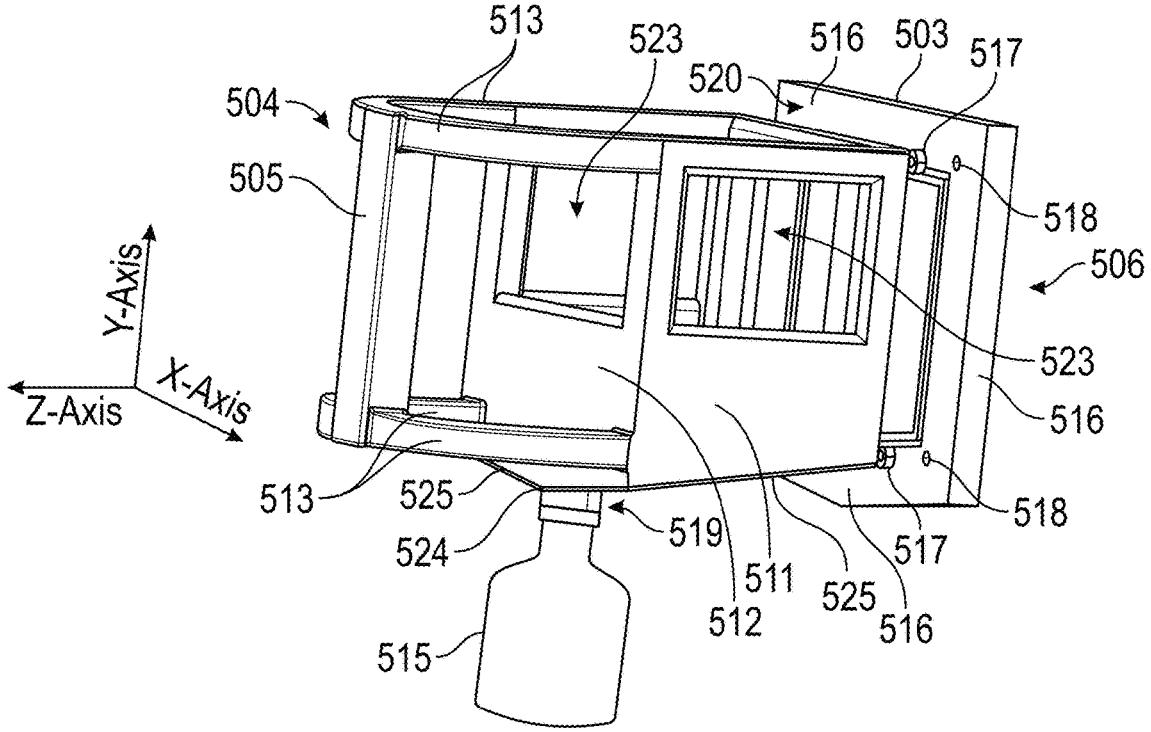

FIGS. 5A and 5B illustrate perspective views of another embodiment of a touch up tool 500. The tool 500 may have any of the features or functions as any other tool described herein, and vice versa. The tool 500 may include a handle 505 at a proximal end attached with a detachable faceplate 503 at a distal end 206, and a reservoir 508 for collecting the excess of the touch up coating 105A.

The faceplate 503 may include one or more, e.g., four, segments 516. The segments 516 may have any of the features or functions as the segments 208 described herein with respect to the tool 200 of FIGS. 2A and 2B, and vice versa. The segments 516 may form a detachable faceplate 503. A lower segment 516 may include a central portion located farther downward relative to laterally outward portions thereof. The lower segment 516 may include halves that are angled downward as shown, for example at an angle to the XZ plane and rotated about the Z-axis. The angled lower segment 516 may create a path to direct the excess of the touch up coating 105A to migrate from the target region 114 proximally to the reservoir 508. In some embodiments, the lower segment 516 may be angled downward in the direction of the reservoir 508, for example at an angle to the XZ plane and rotated about the X-axis. The faceplate 503 may have an outer vertical width W6 and a lateral outer width W7. The widths W6 and W7 may have any of the values as described herein for the widths W1 and W2 for the tool 200 of FIGS. 2A and 2B. The faceplate 503, for example the distal side 522 thereof, may have a thickness T5 extending in the vertical and/or lateral directions. The thickness T5 may have any of the values as described herein for the thickness T1 for the tool 200 of FIGS. 2A and 2B.

The faceplate 503 may include one or more holes 518 on a proximal side 520 of the faceplate 503. The holes 518 may be located at each of four corners of the intersecting segments 516. The holes 518 may be configured to receive a corresponding attachment 517 for attaching the faceplate 503 to the tool 500. The holes 518 may be formed by flexible portions of the proximal side 520 of the faceplate 503 that can deflect to receive and secure the attachment 517 therein. The attachment 517 may be shaped liked a screw. There may be four attachments 517 each corresponding to a respective hole 518.

The faceplate 503 may define an opening 507 therethrough. The opening 507 may have any of the features or functions as the openings at the distal ends of any of the tools described herein, and vice versa. The opening 507 may be defined by the surrounding segments 516. The opening 507 may be angled on a lower side thereof due to the angled lower segment 516. The remaining two lateral sides and upper side of the opening 507 may be straight. The opening 507 may define a polygon. The opening 507 may span a vertical inner distance D6 and a lateral inner distance D6. The distances D6 and D7 may have any of the values as described herein for the distances D1 and D2 for the tool 200 of FIGS. 2A and 2B.

The tool 500 may include a seal 509. The seal 509 may have any of the features or functions as any other seal described herein, and vice versa. The seal 509 may extend along the distal side 522 of the faceplate 503. The seal 509 may extend along a polygonal path. The seal 509 may attach to the faceplate 503, for example in a groove thereof.

The reservoir 508 may have any of the features or functions as described herein with respect to the reservoir 408 of the tool 400 of FIGS. 4A-4D, and vice versa. The reservoir 508 may be defined on a lower side by the runoff portion 501, on lateral sides by two opposing lateral sidewalls 511, and on a proximal side by a proximal end wall 512. The runoff portion 501, sidewalls 511, and end wall 512 may have any of the features or functions respectively as the runoff portion 407, lateral sidewalls 411, and proximal end wall 412 as described herein with respect to the reservoir 408 of the tool 400 of FIGS. 4A-4D, and vice versa. The lateral sidewalls 511 may each define lateral openings 523 therethrough.

The runoff portion 501 may be configured to direct excess of the touch up coating 105A away from the target region 114 and proximally within the reservoir 508. The runoff portion 501 may be angled with respect to a plane that is perpendicular to the direction of gravity. The runoff portion 501 may be angled with respect to the XZ plane and rotated about the X-axis. A proximal end of the runoff portion 501 may be located lower than a distal end of the runoff portion.

The runoff portion 501 may be configured to direct excess of the touch up coating 105A toward a lateral centerline 524 of the reservoir 508. The runoff portion 501 along the centerline 524 may be located lower than laterally outward regions of the runoff portion 501. The runoff portion 501 may include two segments 525 angled about the Z-axis that connect at the centerline 524. An attachment 519 may be located on an underside of the runoff portion 501 and along the centerline 524. The attachment 519 may be a circular protrusion extending downward to define a drain opening therethrough for receiving the excess of the touch up coating 105A from the reservoir 508 into a container 515, such as a bottle, storage tank, or the like. The attachment 519 may be configured to attached to the container 515, for example via threaded connection. The container 515 may be detached from the attachment 519 for disposal or reuse of the excess of the touch up coating 105A therein.

The handle 505 may be configured to receive a user's hand. The handle 505 may have any of the features or functions as described herein with respect to the handle 405 of the tool 400 of FIGS. 4A-4D, and vice versa. The handle 505 may extend linearly and be supported by one or more support members 513. The support members 513 may be curved as shown in planes parallel to the XZ plane. The support members 513 may be straight, angled, curved, or combinations thereof. There may be four support members 513 as shown. The tool may have an overall length L4. The length L4 may extend from the distal side 522 of the faceplate 503 to a proximal side of the handle 505. The length L4 may have any of the values as described herein with respect to the length L1 of the tool 200 of FIGS. 2A and 2B.

Figure 6:
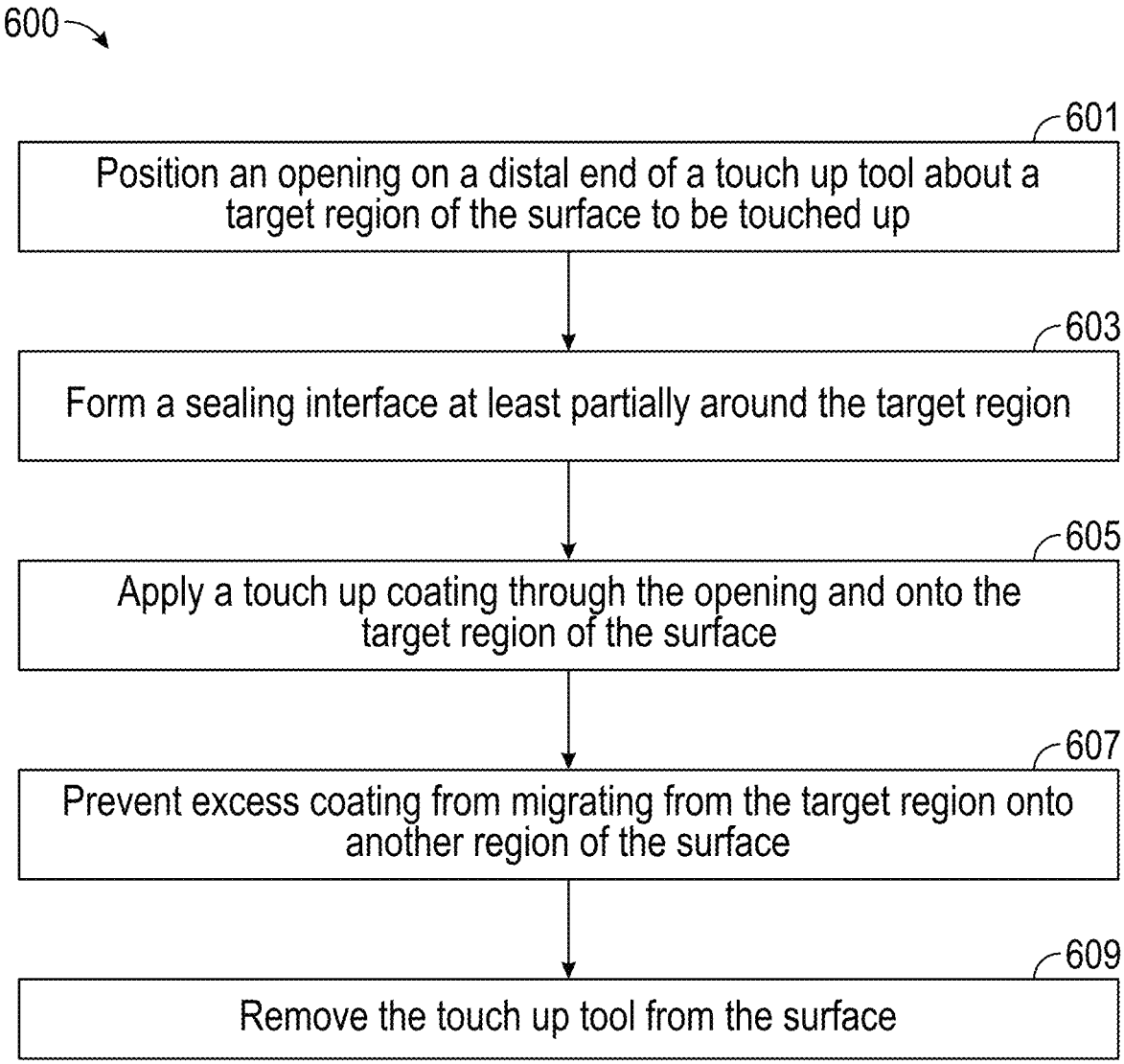
FIG. 6 is a flowchart showing an embodiment of a method of using a touch up tool, such as the tools of FIGS. 1-5, for applying a touch up coating to a surface without the need for masking.

FIG. 6 shows a flowchart of an example method 600 of using a touch up tool, such as those tools shown and described herein. While a user is mentioned, it is possible for the tool to be used in conjunction with or by equipment, such as a robotic arm or a stand. One or more steps described herein may be performed by a machine and/or a human user.

The method begins at step 601, where an opening on a distal end of a touch up tool is positioned about a target region of the surface to be touched up, such as the external surface of a rocket body. The handle of the tool may be grasped. A user or equipment may hold and position the tool. The faceplate may be positioned about the target region on a fairing of the rocket body, on a cylindrical sidewall of the rocket body, or other portions of the rocket. The faceplate may be positioned so that a contour of the faceplate matches the contour of the target region. The target region itself may be selected based on a need for repair of the surface. The target region may be identified by visual inspection, machine inspection, or a combination thereof. The target region may be larger or smaller than the distal opening of the faceplate of the tool. The tool may be applied multiple times to the surface. A seal may be positioned along with the faceplate. The tool may be oriented such that excess coating is directed away from the surface and into the tool.

In step 601, the tool contacts the surface. The faceplate and/or seal of the tool may contact the surface. The tool may be applied with an amount of pressure so as to generate a partial or complete sealing interface with the surface. The user or equipment may hold the tool in place on the surface.

The method 600 then moves to step 603, where a sealing interface is formed at least partially around the target region. The sealing interface may be formed by the faceplate and/or the seal. A leak resistant or fluid impermeable sealing interface may be formed. The sealing interface may extend completely around the target region to form a closed sealing boundary.

The method 600 then moves to step 605, where a touch up coating is applied through the opening and onto the target region of the surface. The coating may be applied through one or more lateral or upper openings of the tool and through the distal opening. The coating may include a touch up coating for chromate conversion or other coating. The coating may be applied using the applicator. The touch up coating may be applied without using masking.

The method 600 then moves to step 607, where excess coating is prevented from migrating from the target region onto another region of the surface. The tool may collect the excess coating. The tool may collect the excess coating in a reservoir of the tool. The collection of excess coating may include non-absorbently collecting the coating, such as receiving the dripping or running coating into the reservoir and/or a container. This may advantageously avoid generation of hazardous waste in the form of used absorbent materials. The excess coating may flow along a runoff portion towards the reservoir or container coupled to an attachment of the tool. The excess coating may be prevented from migrating without using masking.

The method 600 then moves to step 609, where the tool is removed from the surface. The handle of the tool may be grasped. The user or equipment may move the touch up tool proximally away from the surface of the rocket body. The sealing interface with the surface may be removed. An applied pressure to the tool may be decreased. The tool may be held by the user or equipment. The tool may be held away from the surface.

The flow chart sequences are illustrative only. A person of skill in the art will understand that the steps, decisions, and processes embodied in the flowcharts described herein may be performed in an order other than that described herein. Thus, the particular flowcharts and descriptions are not intended to limit the associated processes to being performed in the specific order described.

While the above detailed description has shown, described, and pointed out novel features of the present disclosure as applied to various embodiments, it will be understood that various omissions, substitutions, and changes in the form and details of the device or process illustrated may be made by those skilled in the art without departing from the spirit of the present disclosure. As will be recognized, the present disclosure may be embodied within a form that does not provide all of the features and benefits set forth herein, as some features may be used or practiced separately from others. All changes which come within the meaning and range of equivalency of the claims are to be embraced within their scope.

The term "comprising" as used herein is synonymous with "including," "containing," or "characterized by," and is inclusive or open-ended and does not exclude additional, unrecited elements or method steps. With respect to the use of any plural and/or singular terms herein, those having skill in the art may translate from the plural to the singular and/or from the singular to the plural as is appropriate to the context and/or application. The various singular/plural permutations may be expressly set forth herein for sake of clarity.

It will be understood by those within the art that, in general, terms used herein are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should typically be interpreted to mean "at least one" or "one or more"), and the same holds true for the use of definite articles used to introduce claim recitations.

In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

Unless indicated to the contrary, the numerical parameters set forth in the specification and attached claims are approximations that may vary depending upon the desired properties sought to be obtained by the present disclosure. At the very least, and not as an attempt to limit the application of the doctrine of equivalents to the scope of the claims, each numerical parameter should be construed in light of the number of significant digits and ordinary rounding approaches. For example, terms such as about, approximately, substantially, and the like may represent a percentage relative deviation, in various embodiments, of +1%, +5%, +10%, or +20%.

The above description discloses several methods and materials of the present disclosure. The present disclosure is susceptible to modifications in the methods and materials, as well as alterations in the fabrication methods and equipment. Such modifications will become apparent to those skilled in the art from a consideration of this disclosure. Consequently, it is not intended that the present disclosure be limited to the specific embodiments disclosed herein, but that it covers all modifications and alternatives coming within the true scope and spirit of the present disclosure.

What is claimed is:

1. A tool for touching up a coating on a surface, the tool comprising:

a faceplate configured to be applied to a surface and having a distal opening configured to surround a target region of the surface such that the coating can be applied to the target region through the opening, and the faceplate configured to removably attach to a distal end of the tool;

a handle at a proximal end of the tool, the handle comprising a plurality of linear bars;

a plurality of supports configured to connect the distal end to the proximal end; and at least one lateral opening between the faceplate and the handle that is configured to receive an applicator therethrough for application of the coating to the surface.

2. The tool of claim 1, wherein the faceplate comprises a seal configured to form a sealing interface with at least part of the surface.

3. The tool of claim 1, wherein the faceplate comprises a distal side having a shape that matches a contour of the surface.

4. The tool of claim 1, wherein the faceplate comprises an additively manufactured material.

5. The tool of claim 1, wherein the faceplate comprises a plurality of linear segments.

6. The tool of claim 1, wherein the plurality of linear bars form a cross.

7. The tool of claim 1, wherein the handle and plurality of supports form a cube-shaped body.

8. A tool for touching up a coating of a surface, the tool comprising:

a proximal end comprising a handle, the handle comprising one or more linear bars configured to be grasped by a user;

a faceplate comprising an opening configured to receive an applicator therethrough while the faceplate is positioned on the surface, and a seal coupled to a distal side of the faceplate, the seal configured to form a sealing interface with the surface when the tool is applied to the surface to limit migration of excess coating on the surface; and one or more support members coupling the faceplate with the handle.

9. The tool of claim 8, wherein the faceplate is rounded.

10. The tool of claim 8, wherein the faceplate is ring-shaped.

11. The tool of claim 8, wherein the faceplate is removably coupled with the one or more support members.

12. The tool of claim 8, wherein the one or more support members comprises at least two support members.

13. The tool of claim 12, wherein the at least two support members are curved.

14. The tool of claim 8, wherein the one or more linear bars of the handle comprises a single, linear bar.

15. A tool for touching up a coating on a surface, the tool comprising:

a handle at a proximal end of the tool, the handle configured to be grasped by a user;

one or more support members extending distally from the handle; and a faceplate configured to couple with distal ends of the one or more support members and having an opening configured to surround a target region of the surface and to receive an applicator therethrough while the faceplate is positioned on the surface to apply the coating to the target region of the surface.

16. The tool of claim 15, wherein the faceplate is configured to removably couple with the one or more support members.

17. The tool of claim 15, wherein the handle forms a cross brace.

18. The tool of claim 15, wherein the faceplate is rounded or polygonal.

* * * * *